US009969170B2

(12) United States Patent
Nishida

(10) Patent No.: US 9,969,170 B2
(45) **Date of Patent: *May 15, 2018**

(54) PRINT DEVICE HAVING MAINTENANCE MECHANISM FOR HEAD UNIT

(71) Applicant: BROTHER KOGYO KABUSHIKI KAISHA, Nagoya-shi, Aichi-ken (JP)

(72) Inventor: Katsunori Nishida, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/432,467

(22) Filed: Feb. 14, 2017

(65) Prior Publication Data

US 2017/0232746 A1 Aug. 17, 2017

(30) Foreign Application Priority Data

Feb. 16, 2016 (JP) ..... 2016-026780
Feb. 7, 2017 (JP) ..... 2017-020095

(51) Int. Cl.
*B41J 2/165* (2006.01)
*B41J 2/17* (2006.01)

(52) U.S. Cl.
CPC ..... *B41J 2/16505* (2013.01); *B41J 2/16532* (2013.01); *B41J 2/1714* (2013.01)

(58) Field of Classification Search
CPC .. B41J 2/16505; B41J 2/16532; B41J 2/1754; B41J 2/16523; B41J 2/1714
See application file for complete search history.

(56) References Cited

U.S. PATENT DOCUMENTS 5,835,109 A 11/1998 Uchida
6,406,123 B1 6/2002 Usui et al.
7,255,420 B2 8/2007 Usuda
7,901,033 B2 3/2011 Nishida
2008/0192083 A1* 8/2008 Nishida ..... B41J 2/16532 347/30
2011/0279518 A1* 11/2011 Love ..... B41J 2/16585 347/22
2017/0232746 A1 8/2017 Nishida

FOREIGN PATENT DOCUMENTS

JP 2009-012389 A 1/2009

OTHER PUBLICATIONS

Co Pending U.S. Appl. No. 15/432,517, filed Feb. 14, 2017.
Office Action for related U.S. Appl. No. 15/432,517; action dated Sep. 21, 2017; (10 pages).

* cited by examiner

*Primary Examiner* — Henok Legesse
(74) *Attorney, Agent, or Firm* — K&L Gates LLP

(57) ABSTRACT

A print device includes a head, a cap, a suction portion, an absorption member, and a plate-shaped member. The head has an ejection surface. The ejection surface has a plurality of nozzles formed in the ejection surface and is directed in a predetermined direction. The cap has a frame-shaped wall portion and a suction opening. The suction portion is connected to the inside of the cap via the suction opening. The absorption member is arranged in a position surrounded by the frame-shaped wall portion and is configured to absorb liquid. The plate-shaped member is arranged in a position surrounded by the frame-shaped wall portion and is extending along an inner end surface of the frame-shaped wall portion.

8 Claims, 11 Drawing Sheets

PRINT DEVICE HAVING MAINTENANCE MECHANISM FOR HEAD UNIT

CROSS-REFERENCE TO RELATED APPLICATION

This application claims priority to Japanese Patent Applications No. 2016-26780 filed Feb. 16, 2016 and No. 2017-20095 filed Feb. 7, 2017. The contents of the foregoing applications are hereby incorporated herein by reference.

BACKGROUND

The present disclosure relates to a print device.

Print devices are known that are provided with a cap member configured to be firmly attached to an ejection surface in which nozzles are formed. For example, a known print device is provided with a line head, a cap member, a suction pump and a fluid collection member. The line head has a nozzle formation surface that is provided with nozzle openings. The cap member is provided with a frame-shaped seal portion that is configured to be firmly attached to the nozzle formation surface such that the seal portion surrounds the nozzle openings. The seal portion is formed of an elastomer, which is an example of an elastic body. The suction pump is connected to a suction opening provided in the cap member. The fluid collection member is housed in the cap member, and is positioned above the suction opening. The fluid collection member is impregnated with an ink component, which is an example of a fluid component. When the line head moves downward to a position where the line head is firmly attached to the seal portion, the inside of the cap member is sealed. After that, the suction pump decreases a pressure of an inside space of the cap member. Thus, the ink is forcibly discharged from the nozzle openings, and is sucked by the suction pump.

SUMMARY

A print device is conceivable that is provided with a restriction member that restricts the seal portion from being deformed inwardly due to a decrease in the pressure of the inside space of the cap member. For example, it is conceivable that the restriction member has a frame shape and is disposed between an inner end surface of the seal portion and the fluid collection member.

There is a case in which droplets are generated in the fluid collection member. In this case, it is conceivable that the suction pump sucks the droplets in a state in which the line head has been separated upward from the seal portion and the cap member has been released. However, in an area of the inside space that is separated from the suction opening, an air flow toward the suction opening is less likely to be generated than in an area of the inside space that is close to the suction opening. Therefore, the suction pump may not be able to uniformly suck the droplets generated in the fluid collection member.

Embodiments of the broad principles derived herein provide a print device that may suppress deformation of a cap from occurring due to a pressure decrease inside the cap, and may easily and uniformly suck droplets generated inside the cap.

The embodiments herein provide a print device that includes a head, a cap, a suction portion, an absorption member, and a plate-shaped member. The head has an ejection surface. The ejection surface has a plurality of nozzles formed in the ejection surface and is directed in a predetermined direction. The cap has a frame-shaped wall portion and a suction opening. The frame-shaped wall portion is formed by an elastic body. The frame-shaped wall portion is configured to relatively move in a direction in which the frame-shaped wall portion comes into contact with and separates from the ejection surface. The frame-shaped wall portion surrounds the plurality of nozzles when the frame-shaped wall portion comes into contact with the ejection surface. The suction opening is formed in a position surrounded by the frame-shaped wall portion. The suction portion is connected to the inside of the cap via the suction opening. The absorption member is arranged in a position surrounded by the frame-shaped wall portion and is configured to absorb liquid. The plate-shaped member is arranged in a position surrounded by the frame-shaped wall portion and is extending along an inner end surface of the frame-shaped wall portion. The plate-shaped member has a first surface, a second surface, a third surface, a fourth surface and a recessed portion. The first surface is directed in the predetermined direction. The second surface is directed in a direction opposite to the predetermined direction. The third surface faces the inner end surface of the frame-shaped wall portion and connects the first surface and the second surface. The fourth surface faces the absorption member and connects the first surface and the second surface. The recessed portion includes at least one of a first recessed portion and a second recessed portion. The first recessed portion is provided in the first surface and is recessed toward the second surface and extends between the third surface and the fourth surface. The second recessed portion is provided in the third surface and is recessed toward the fourth surface and extends between the first surface and the second surface.

BRIEF DESCRIPTION OF THE DRAWINGS

Embodiments will be described below in detail with reference to the accompanying drawings in which.

DETAILED DESCRIPTION

Figure 1:
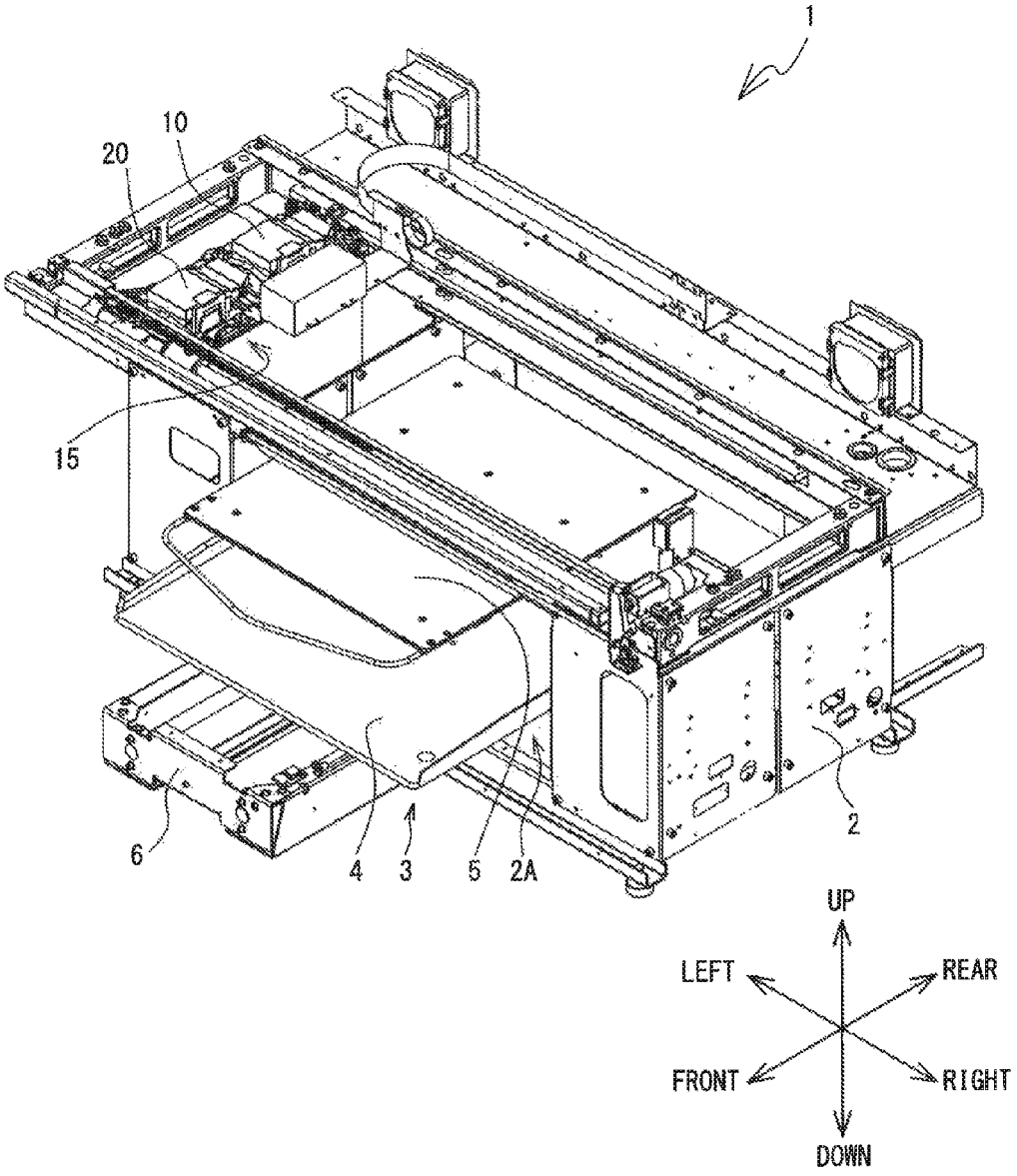
FIG. 1 is a perspective view of a print device.

An embodiment will be explained with reference to the drawings. An overall configuration of a print device 1 will be explained with reference to FIG. 1. The upper side, the lower side, the lower right side, the upper left side, the lower left side and the upper right side of FIG. 1 respectively correspond to the upper side, the lower side, the right side, the left side, the front side and the rear side of the print device 1.

The print device 1 is an inkjet printer that performs printing by ejecting liquid ink onto the surface of a fabric (not shown in the drawings), such as a T-shirt, which is a print medium. The print device 1 prints a color image on the print medium by downwardly ejecting five types of ink (white, black, cyan, magenta and yellow inks) that are different from each other. In the explanation below, when the five types of ink are collectively referred to, they are referred to as ink. The white color ink is referred to as a white ink. When the inks of the four colors of black, cyan, magenta and yellow are collectively referred to, they are referred to as color inks. The ink contains a binder resin so that the printed fabric can produce a high level of washing fastness. The white ink contains, for example, titanium oxide as a pigment. The titanium oxide is an inorganic pigment having a relatively high specific gravity, and has a high sedimentation property. Therefore, the white ink is a liquid containing a component that is more likely to sediment than components contained in the color inks.

For example, when an image is printed on a fabric whose base color is dark, the white ink is ejected as a base before the printing is performed using the color inks. Depending on the printed image, the color inks need not necessarily be ejected after the white ink has been ejected.

As shown in FIG. 1, the print device 1 is provided with a housing 2, a platen mechanism 3, a carriage 15, a maintenance mechanism 30 (refer to FIG. 3) and the like. The front surface of the housing 2 is provided with an opening 2A that is communicated with the inside of the housing 2.

The platen mechanism 3 is a mechanism to feed the fabric (not shown in the drawings) in the front-rear direction, and is provided on the inside of the housing 2. The platen mechanism 3 is provided with a base 6, a tray 4, a platen 5 and the like. The base 6 has a substantially box shape that extends in the front-rear direction passing through the opening 2A. A pair of rails (not shown in the drawings) that extend in the front-rear direction are provided on the inside of the base 6.

The tray 4 is a plate body that is substantially rectangular in a plan view, and is provided above the base 6. The tray 4 is configured to move along the pair of rails in accordance with the drive of a platen drive motor (not shown in the drawings). The platen 5 is a plate body that is substantially rectangular in a plan view, and is supported by a support pillar (not shown in the drawings) that stands upward from a rear end portion of the tray 4. A section of the fabric that is to be printed (for example, a front body of a T-shirt) can be placed on an upper surface of the platen 5. Sections of the fabric that are not to be printed (for example, a sleeve or the like of the T-shirt) can be placed on an upper surface of the tray 4. The platen 5 is configured to move along the pair of rails together with the tray 4.

A guide rail and a guide shaft, which are not shown in the drawings, are provided on an upper end portion of the housing 2. The guide rail is a cuboid member that protrudes forward from the rear side. The guide shaft is provided on the front side, and extends in the left-right direction.

The carriage 15 is provided above the platen mechanism 3, and is configured to reciprocate in the left-right direction along the guide rail and the guide shaft. The carriage 15 moves in accordance with the drive of a carriage drive motor (not shown in the drawings). When the print device 1 is not performing a print operation, the carriage 15 is arranged in a standby position. The standby position is a leftmost position in an area within which the carriage 15 can move. The carriage 15 shown in FIG. 1 is positioned in the standby position. A first head unit 10 that ejects the white ink and a second head unit 20 that ejects the color inks are provided on the carriage 15 such that they are arranged side by side in the front-rear direction. The first head unit 10 is positioned to the rear of the second head unit 20.

Figure 2:
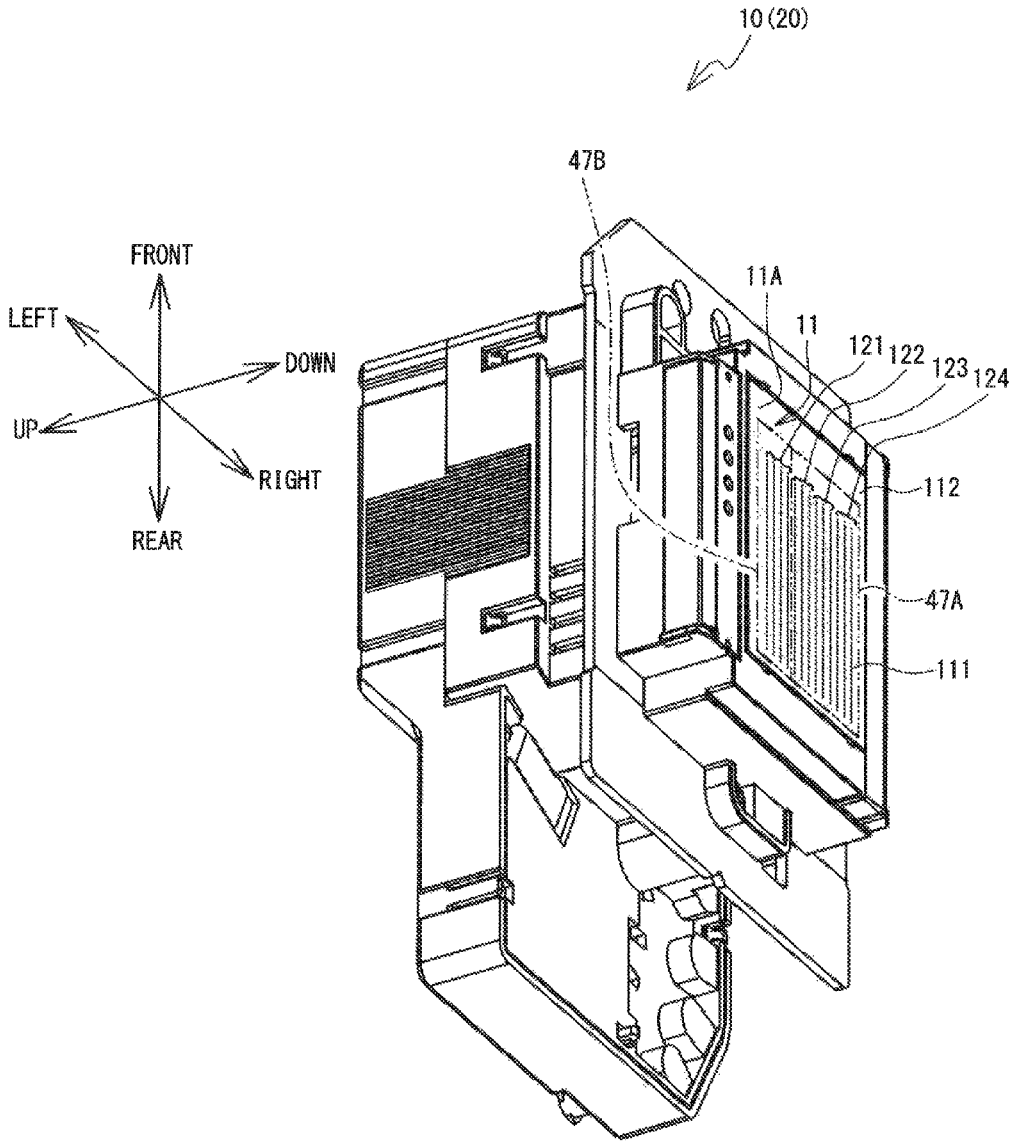
FIG. 2 is a perspective view of a first head unit.

The first head unit 10 shown in FIG. 2 is connected to four main tanks (not shown in the drawings) that store the white ink, via four white ink supply tubes (not shown in the drawings). The first head unit 10 has a head 11 that is formed in a plate shape. The head 11 has an ejection surface 11A that is directed downward. Nozzle arrangements 121 to 124 are formed in the ejection surface 11A. The nozzle arrangements 121 to 124 are arranged sequentially from the left to the right with a space between each of them. Each of the nozzle arrangements 121 to 124 has a plurality of nozzle arrays. Each of the nozzle arrays has an array of a plurality of nozzles 111 that are arranged side by side in the front-rear direction in the ejection surface 11A. The white ink stored in the four main tanks is supplied to the nozzle arrangements 121 to 124 of the first head unit 10, respectively, via the four white ink supply tubes.

The second head unit 20 has a similar structure to that of the first head unit 10. More specifically, the second head unit 20 has the head 11. The second head unit 20 is connected to four main tanks (not shown in the drawings) via four color ink supply tubes (not shown in the drawings). The four main tanks store the color inks that are different from each other. The color inks that are different from each other are supplied, respectively, to the nozzle arrangements 121 to 124 formed in the ejection surface 11A of the second head unit 20.

Figure 3:
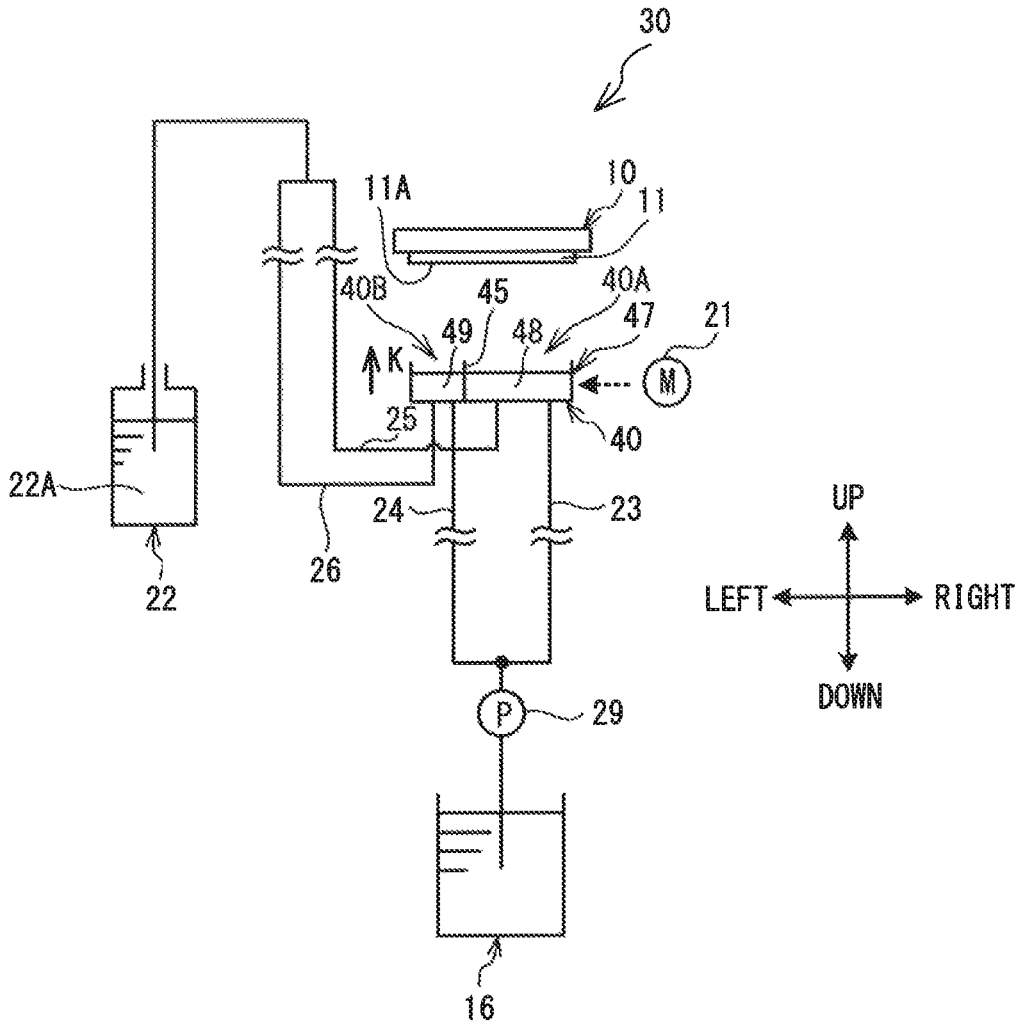
FIG. 3 is a schematic view of a maintenance mechanism.
Figure 4:
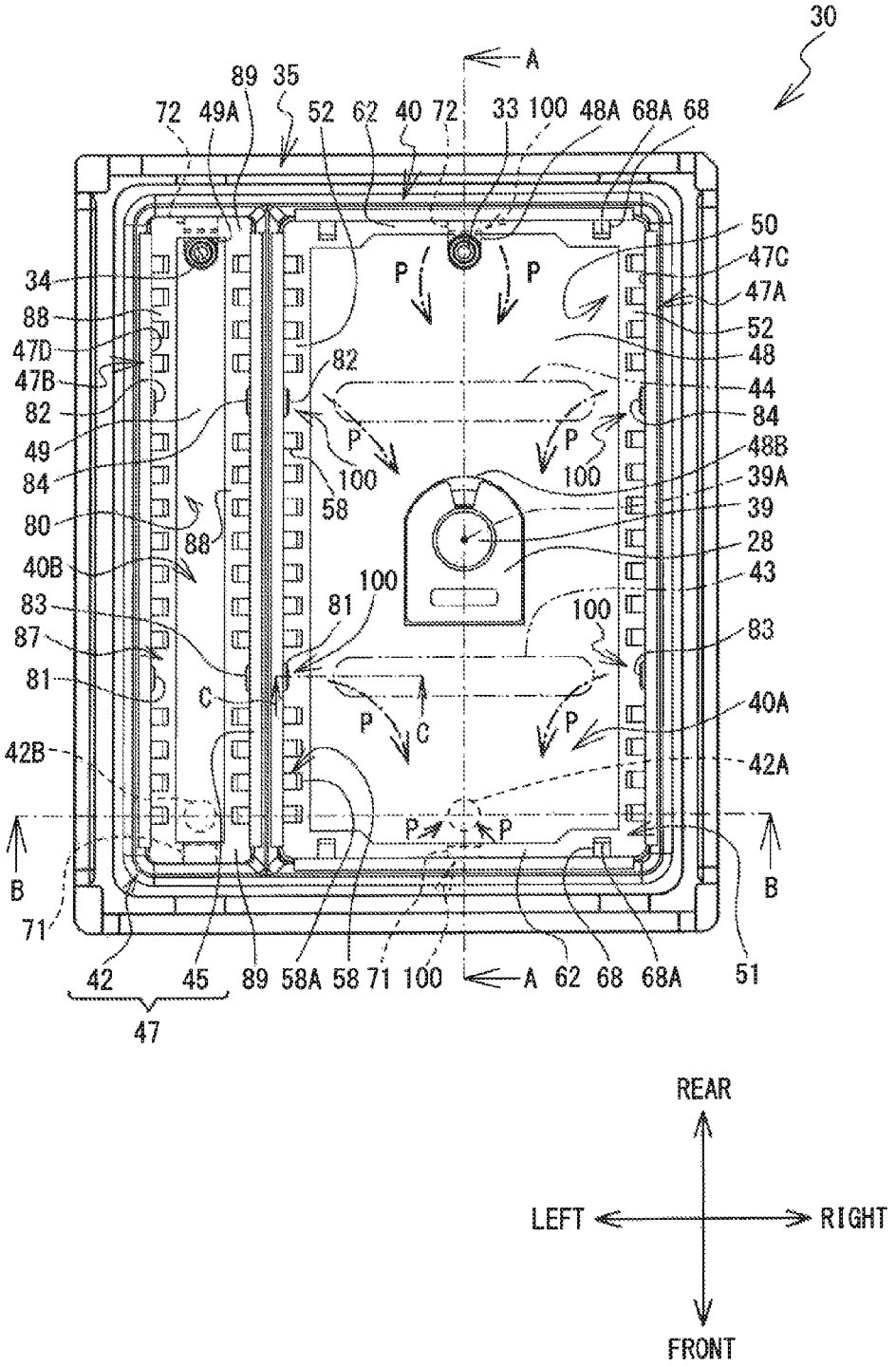
FIG. 4 is a plan view of the maintenance mechanism.

The maintenance mechanism 30 will be explained with reference to FIG. 3 to FIG. 7. A holding member 35 and plate-shaped members 50 and 80, which are shown in FIG. 4 and which will be described later, are not illustrated in FIG. 3. FIG. 3 shows the first head unit 10 of the carriage 15 in the standby position. The maintenance mechanism 30 is a mechanism that performs maintenance operations for each of the first head unit 10 and the second head unit 20. Hereinafter, among the structural members of the maintenance mechanism 30, the structural members used to perform maintenance on the first head unit 10 will be explained.

The maintenance operations include capping, purging, idle suction and cleaning. The capping is an operation that seals the ejection surface 11A (refer to FIG. 2) using a cap 40. The purging is an operation that sucks the ink from the ejection surface 11A (refer to FIG. 2). The idle suction is an operation that sucks liquid held by the cap 40 (refer to FIG. 3) using a suction portion 29. The liquid held by the cap 40 is a liquid, such as ink, a cleaning liquid 22A (refer to FIG. 3) or the like, for example. The cleaning is an operation that flushes out the liquid held by the cap 40 using the cleaning liquid 22A.

As shown in FIG. 3, the maintenance mechanism 30 is provided with the suction portion 29 and the holding member 35. The suction portion 29 is provided below the standby position of the carriage 15 (refer to FIG. 1). The suction portion 29 is a known tube pump type suction pump, for example, and is connected to a waste liquid tank 16.

The holding member 35 is provided above the suction portion 29 and below the standby position of the carriage 15. The holding member 35 has a substantially box shape that is open upward. The holding member 35 is configured to move in the up-down direction in accordance with the drive of a vertical movement motor 21 provided inside the housing 2 (refer to FIG. 1).

Figure 6:
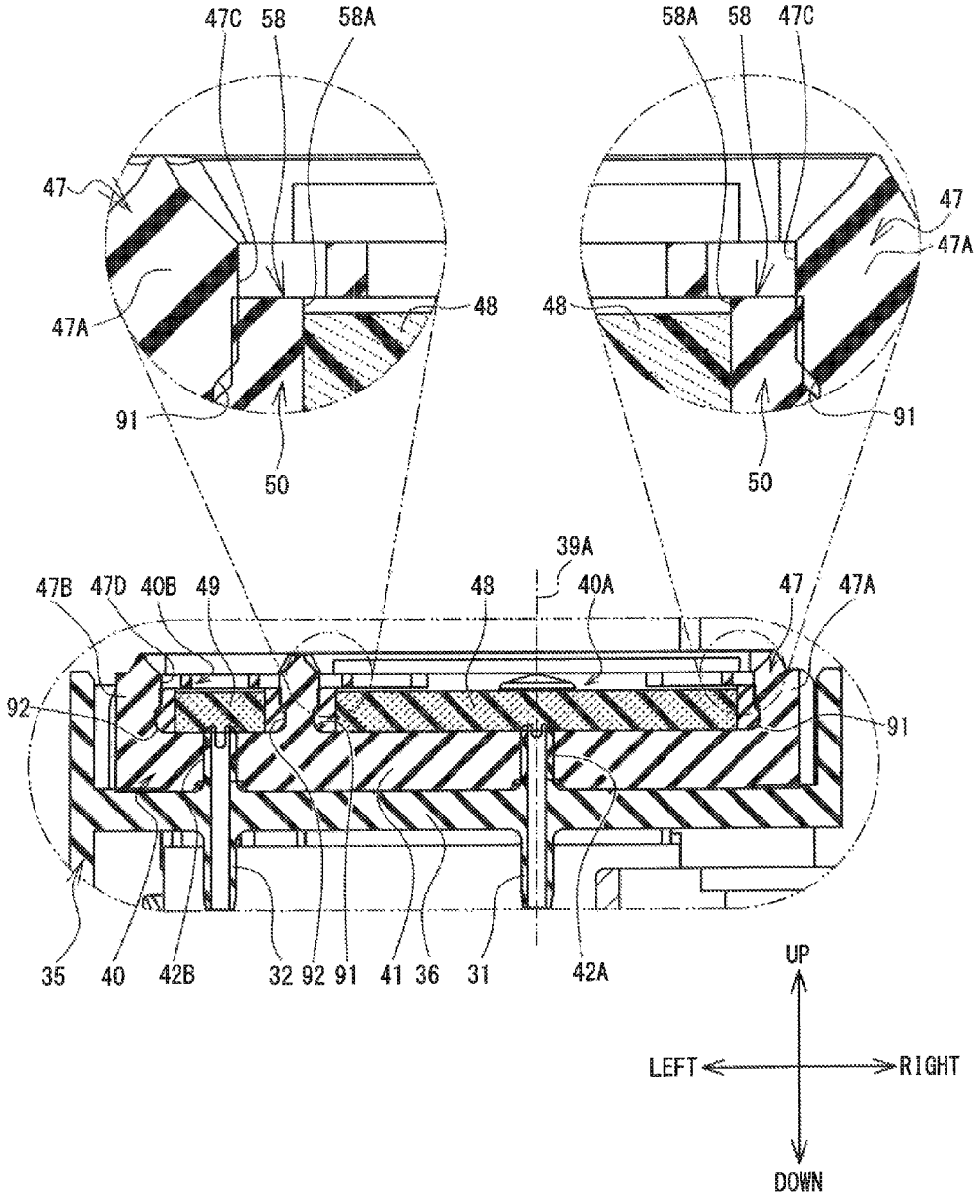
FIG. 6 is a cross-sectional view of the holding member and the cap taken along a line B-B in the direction of arrows shown in FIG. 4.

As shown in FIG. 4 and FIG. 6, the holding member 35 is provided with a holding wall portion 36, a right suction path 31, a left suction path 32, a right cleaning path 33, a left cleaning path 34 and a cylindrical protrusion portion 39.

The holding wall portion 36 has a substantially rectangular shape that extends in the front-rear direction and the left-right direction in a plan view. The right suction path 31 and the left suction path 32 are provided in a front portion of the holding wall portion 36. The right suction path 31 is provided in a right portion of the holding wall portion 36. The left suction path 32 is provided in a left portion of the holding wall portion 36. The right suction path 31 and the left suction path 32 each have a cylindrical shape that penetrates the holding wall portion 36 in the up-down direction. The right suction path 31 and the left suction path 32 are connected to the suction portion 29, respectively, via a right tube 23 (refer to FIG. 3) and a left tube 24 (refer to FIG. 3). The right tube 23 and the left tube 24 are respectively provided with first valves (not shown in the drawings). The first valves are electrically connected to a control portion (not shown in the drawings) provided on the inside of the housing 2. The control portion switches the first valves between an open state and a closed state. When the corresponding first valve is switched to the open state in the right tube 23, the right suction path 31 and the suction portion 29 are communicated with each other. When the corresponding first valve is switched to the closed state in the right tube 23, the communicative connection between the right suction path 31 and the suction portion 29 is disconnected. In a similar manner, also in the left tube 24, when the corresponding first valve is switched between the open state and the closed state by the control portion, the communication state between the left suction path 32 and the suction portion 29 is switched.

Figure 5:
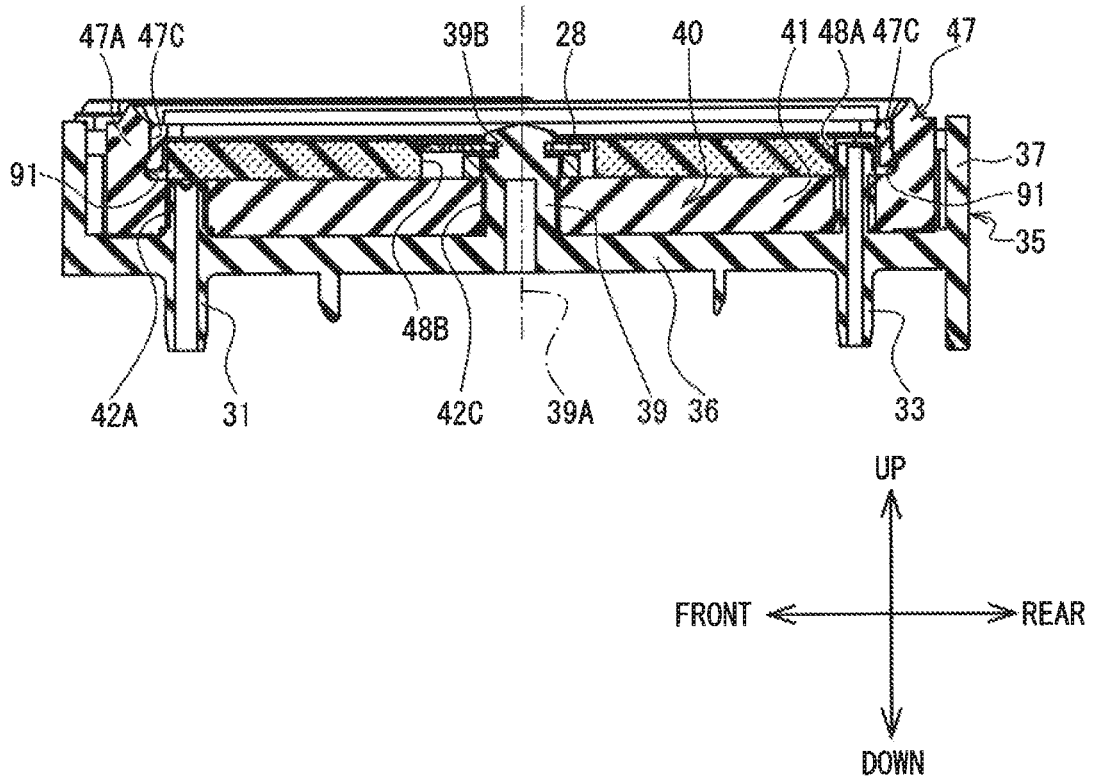
FIG. 5 is a cross-sectional view of a holding member and a cap taken along a line A-A in the direction of arrows shown in FIG. 4.

As shown in FIG. 4 and FIG. 5, the right cleaning path 33 and the left cleaning path 34 are provided in a rear portion of the holding wall portion 36. The right cleaning path 33 is provided in a right portion of the holding wall portion 36, and the left cleaning path 34 is provided in a left portion of the holding wall portion 36. The right cleaning path 33 and the left cleaning path 34 each have a cylindrical shape that penetrates the holding wall portion 36 in the up-down direction. The right cleaning path 33 is positioned to the rear of the right suction path 31. The left cleaning path 34 is positioned to the rear of the left suction path 32. The right cleaning path 33 and the left cleaning path 34 are connected to a cleaning liquid tank 22 (refer to FIG. 3), respectively, via a right cleaning tube 25 (refer to FIG. 3) and a left cleaning tube 26 (refer to FIG. 3). The cleaning liquid tank 22 stores the cleaning liquid 22A that is used to clean the maintenance mechanism 30.

The right cleaning tube 25 and the left cleaning tube 26 are respectively provided with second valves (not shown in the drawings). The second valves are electrically connected to the aforementioned control portion (not shown in the drawings). The control portion switches the second valves between an open state and a closed state. When the corresponding second valve is switched to the open state in the right cleaning tube 25, the right cleaning path 33 and the cleaning liquid tank 22 are communicated with each other. When the corresponding second valve is switched to the closed state in the right cleaning tube 25, the communicative connection between the right cleaning path 33 and the cleaning liquid tank 22 is disconnected. In a similar manner, also in the left cleaning tube 26, when the corresponding second valve is switched between the open state and the closed state by the control portion, the communication state between the left cleaning path 34 and the cleaning liquid tank 22 is switched.

As shown in FIG. 4 and FIG. 5, the cylindrical protrusion portion 39 protrudes upward from the holding wall portion 36 between the right suction path 31 and the right cleaning path 33. An axis line 39A of the cylindrical protrusion portion 39 extends in the up-down direction. A groove portion 39B that is recessed toward the axis line 39A is formed in a peripheral surface of an upper end portion of the cylindrical protrusion portion 39. The groove portion 39B is formed in the peripheral surface of the cylindrical protrusion portion 39, along the circumferential direction around the axis line 39A. A retainer ring 28 is provided in the groove portion 39B.

The cap 40 is held on the inside of the holding member 35. The cap 40 has a substantially box shape that is open upward. The cap 40 is formed of a rubber material, which is an example of the elastic body. The cap 40 is provided with a bottom wall portion 41 and a contact wall portion 47. The bottom wall portion 41 is a wall portion that is held by the holding wall portion 36 of the holding member 35. The shape of the bottom wall portion 41 is a substantially rectangular shape that extends in the front-rear direction and the left-right direction in a plan view.

The bottom wall portion 41 is provided with holes respectively corresponding to the right suction path 31, the left suction path 32, the right cleaning path 33, the left cleaning path 34 and the cylindrical protrusion portion 39. The right cleaning path 33, the left cleaning path 34 and the cylindrical protrusion portion 39 protrude upward via the holes of the bottom wall portion 41. The holes of the bottom wall portion 41 that correspond to the right suction path 31 and the left suction path 32 are suction openings 42A and 42B, respectively. The hole of the bottom wall portion 41 that corresponds to the cylindrical protrusion portion 39 is a hole 42C. The cylindrical protrusion portion 39 is fitted into the hole 42C. The hole 42C is smaller than the retainer ring 28 in a plan view. Therefore, the movement of the cap 40 toward the outside of the holding member 35 is restricted by the retainer ring 28. Note that the cylindrical protrusion portion 39 may be fitted into the hole 42C via a spacer (not shown in the drawings) formed in a cylindrical shape.

The contact wall portion 47 is a wall portion that extends upward from the bottom wall portion 41. An upper end portion of the contact wall portion 47 tapers as it extends upward. As a result of the holding member 35 moving up and down in accordance with the drive of the vertical movement motor 21 (refer to FIG. 3), the upper end portion of the contact wall portion 47 can come into contact with and separate from the ejection surface 11A of the first head unit 10. More specifically, the contact wall portion 47 is a so-called cap lip.

As shown in FIG. 4, the contact wall portion 47 includes a peripheral wall portion 42 and a partition wall portion 45. The peripheral wall portion 42 extends upward from a peripheral edge portion of the bottom wall portion 41 (refer to FIG. 5). The shape of the peripheral wall portion 42 is a rectangular frame shape in a plan view. An upper end portion of the peripheral wall portion 42 can come into contact with and separate from a peripheral edge portion of the ejection surface 11A (refer to FIG. 2) of the first head unit 10. The partition wall portion 45 extends in the front-rear direction passing between the right suction path 31 and the left suction path 32 and between the right cleaning path 33 and the left cleaning path 34. The partition wall portion 45 is connected to the peripheral wall portion 42. Therefore, the space inside the cap 40, which is surrounded by the bottom wall portion 41 and the peripheral wall portion 42, is divided into two by the partition wall portion 45. Further, with respect to the ejection surface 11A of the first head unit 10, an upper end portion of the partition wall portion 45 can come into contact with and separate from a section of the ejection surface 11A that is positioned between the nozzle arrangement 121 and the nozzle arrangement 122 shown in FIG. 2.

Hereinafter, the space inside the cap 40 that is located to the right of the partition wall portion 45 is referred to as a right space 40A (refer to FIG. 3). The space inside the cap 40 that is located to the left of the partition wall portion 45 is referred to as a left space 40B (refer to FIG. 3). More specifically, the right space 40A is below the nozzle arrangements 122 to 124 of the first head unit 10. The left space 40B is below the nozzle arrangement 121 of the first head unit 10.

Of the contact wall portion 47, a section that surrounds the right space 40A is referred to as a first frame-shaped wall portion 47A. Of the contact wall portion 47, a section that surrounds the left space 40B is referred to as a second frame-shaped wall portion 47B. The first frame-shaped wall portion 47A and the second frame-shaped wall portion 47B extend upward from the bottom wall portion 41. Each of the first frame-shaped wall portion 47A and the second frame-shaped wall portion 47B has a rectangular frame shape in a plan view. The first frame-shaped wall portion 47A surrounds the right suction path 31, the suction opening 42A and the right cleaning path 33. The second frame-shaped wall portion 47B surrounds the left suction path 32, the suction opening 42B and the left cleaning path 34. Further, an end surface on the inside of the first frame-shaped wall portion 47A is referred to as a first inner end surface 47C (refer to FIG. 6). An end surface on the inside of the second frame-shaped wall portion 47B is referred to as a second inner end surface 47D (refer to FIG. 6). A first groove portion 91 (refer to FIG. 6) is formed in a lower portion of the first inner end surface 47C, and a second groove portion 92 (refer to FIG. 6) is formed in a lower portion of the second inner end surface 47D. The first groove portion 91 is recessed in a direction separating from the axis line 39A. In other words, the right space 40A is wider on the lower side. The second groove portion 92 is formed in the same manner as the first groove portion 91. The left space 40B is wider on the lower side. Note that, in FIG. 2, the first frame-shaped wall portion 47A and the second frame-shaped wall portion 47B when the contact wall portion 47 is in contact with the ejection surface 11A of the first head unit 10 are schematically shown by two dotted lines. When the contact wall portion 47 comes into contact with the ejection surface 11A, the first frame-shaped wall portion 47A surrounds the nozzle arrangements 122 to 124, and the second frame-shaped wall portion 47B surrounds the nozzle arrangement 121.

As shown in FIG. 4 and FIG. 6, an absorption member 48 is housed in the right space 40A and an absorption member 49 is housed in the left space 40B. The absorption member 48 is placed on the bottom wall portion 41 of the cap 40, in a position where the absorption member 48 is surrounded by the first frame-shaped wall portion 47A. The absorption member 49 is placed on the bottom wall portion 41 in a position where the absorption member 49 is surrounded by the second fame-shaped wall portion 47B. The absorption members 48 and 49 have a rectangular shape that extends in the front-rear direction in a plan view. The absorption members 48 and 49 respectively cover the right suction path 31 and the left suction path 32 of the holding member 35, from above. The absorption members 48 and 49 are members configured to hold liquid, and are made of sponge, for example. The absorption members 48 and 49 respectively absorb liquid, such as the cleaning liquid 22A, in order to maintain the humidity of the right space 40A and the left space 40B. An exposure hole 48A to upwardly expose the right cleaning path 33 is formed in the absorption member 48. An exposure hole 49A to upwardly expose the left cleaning path 34 is formed in the absorption member 49. A through hole 48B, through which the cylindrical protrusion portion 39 of the holding member 35 is inserted, is formed in a central portion of the absorption member 48. The through hole 48B is positioned above the hole 42C of the cap 40. The retainer ring 28 is housed inside the through hole 48B.

The plate-shaped member 50 is provided between the first frame-shaped wall portion 47A and the absorption member 48. The plate-shaped member 80 is provided between the second frame-shaped wall portion 47B and the absorption member 49. The plate-shaped members 50 and 80 are plate-shaped members having a thickness in the up-down direction. The plate-shaped members 50 and 80 of this example are formed of a resin material. In other words, the hardness of the material used to form the plate-shaped members 50 and 80 is greater than the hardness of the material used to form the cap 40. Since the plate-shaped members 50 and 80 have structures that are similar to each other, hereinafter, the structure of the plate-shaped member 50 will be explained in detail and the structure of the plate-shaped member 80 will be explained briefly.

Figure 7:
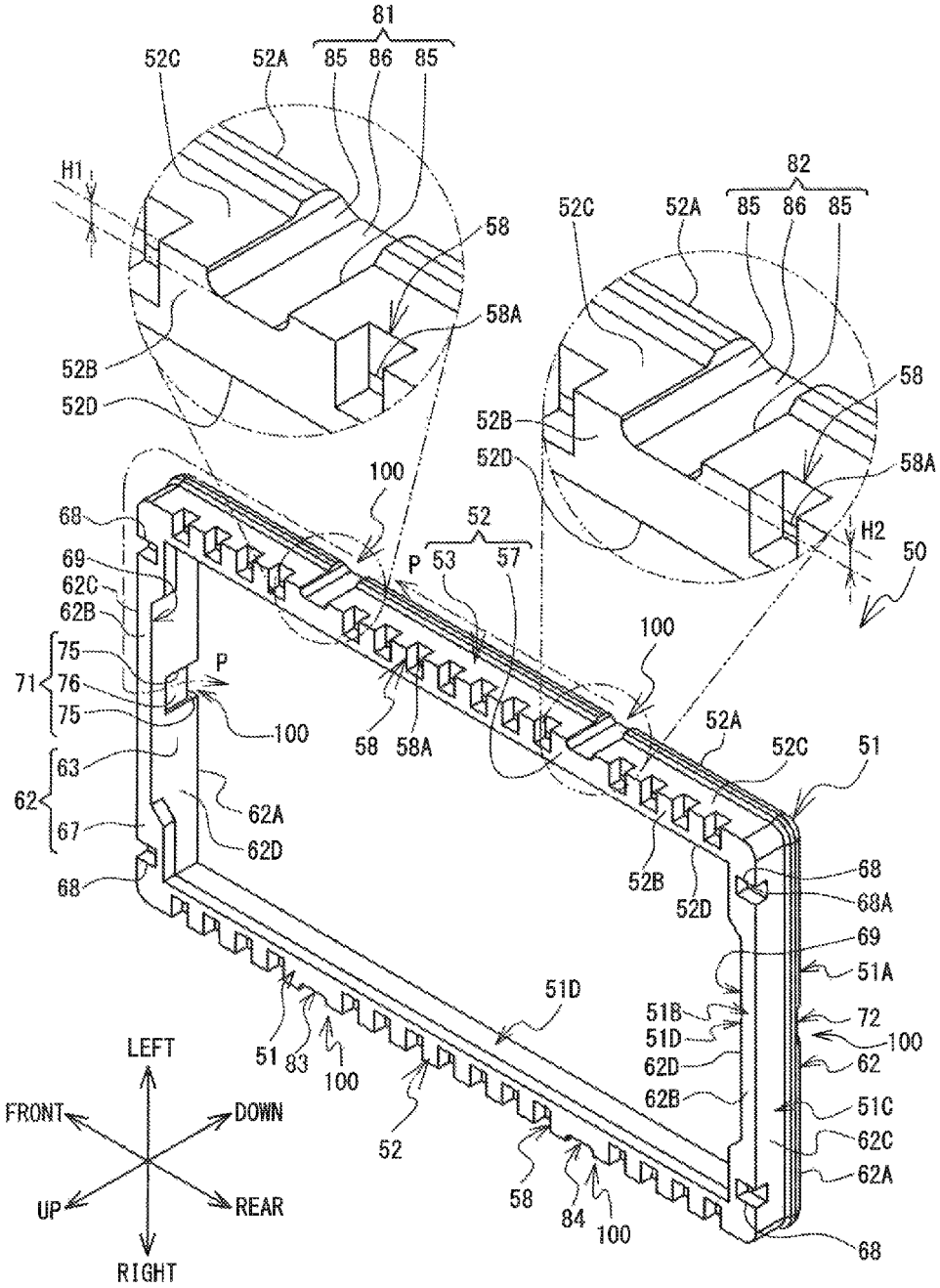
FIG. 7 is a perspective view of a plate-shaped member.

As shown in FIG. 4 and FIG. 7, the plate-shaped member 50 is provided with a base portion 51. The base portion 51 is surrounded by the first frame-shaped wall portion 47A, and is disposed in a position where the base portion 51 faces a peripheral surface of the absorption member 48. More specifically, the base portion 51 extends along the first inner end surface 47C of the first frame-shaped wall portion 47A such that the first inner end surface 47C and the absorption member 48 are partitioned from each other. The base portion 51 is a frame that is rectangular in a plan view. A center position of a pair of opposing corners of the base portion 51 substantially matches the axis line 39A of the holding member 35 in a plan view. In other words, the shape of the base portion 51 is point symmetric with respect to the axis line 39A.

As shown in FIG. 7, the base portion 51 is provided with a first surface 51A, a second surface 51B, a third surface 51C and a fourth surface 51D. Of the surfaces of the base portion 51, the first surface 51A is a downwardly directed surface. Of the surfaces of the base portion 51, the second surface 51B is an upwardly directed surface. Of the surfaces of the base portion 51, the third surface 51C is a surface that faces the first inner end surface 47C of the first frame-shaped wall portion 47A (refer to FIG. 4), and connects the first surface 51A and the second surface 51B. The fourth surface 51D is a surface that faces the peripheral surface of the absorption member 48 (refer to FIG. 4), and connects the first surface 51A and the second surface 51B. The fourth surface 51D is positioned on an opposite side to the first inner end surface 47C of the first frame-shaped wall portion 47A with respect to the third surface 51C.

The base portion 51 is formed by a pair of long wall portions 52 and a pair of short wall portions 62. The pair of long wall portions 52 are wall portions that extend in the front-rear direction. The pair of long wall portions 52 face each other in the left-right direction with a space therebetween. The pair of short wall portions 62 are wall portions that extend in the left-right direction. The pair of short wall portions 62 face each other in the front-rear direction with a space therebetween. The length of the short wall portions 62 in the left-right direction is shorter than the length of the long wall portions 52 in the front-rear direction. In this example, the pair of long wall portions 52 and the pair of short wall portions 62 are formed integrally with each other.

Hereinafter, of the first surface 51A of the base portion 51, a section that forms the surface of the long wall portion 52 is referred to as a lower end surface 52A, and a section that forms the surface of the short wall portion 62 is referred to as a lower end surface 62A. Further, of the second surface 51B of the base portion 51, a section that forms the surface of the long wall portion 52 is referred to as an upper end surface 52B, and a section that forms the surface of the short wall portion 62 is referred to as an upper end surface 62B. Further, of the third surface 51C of the base portion 51, a section that forms the surface of the long wall portion 52 is referred to as an outer end surface 52C, and a section that forms the surface of the short wall portion 62 is referred to as an outer end surface 62C. Further, of the fourth surface 51D of the base portion 51, a section that forms the surface of the long wall portion 52 is referred to as an inner end surface 52D, and a section that forms the surface of the short wall portion 62 is referred to as an inner end surface 62D.

Each of the long wall portions 52 has a first wall portion 53 and a first protrusion portion 57. The first wall portion 53 is provided between the first frame-shaped wall portion 47A and the absorption member 48 (refer to FIG. 4). The first wall portion 53 faces the first inner end surface 47C of the first frame-shaped wall portion 47A.

The first protrusion portion 57 protrudes from an upper end portion of the first wall portion 53, in a direction from the outer end surface 52C toward the inner end surface 52D. The first protrusion portion 57 is directly above an end portion of the absorption member 48 in the left-right direction, and is below the upper end portion of the contact wall portion 47 (refer to FIG. 4) of the cap 40. Note that, when the first head unit 10 is in the standby position, the first protrusion portion 57 may be below the nozzle array at the left end of the nozzle arrangement 122 (refer to FIG. 2) or below the nozzle array at the right end of the nozzle arrangement 124 (refer to FIG. 2). The first protrusion portion 57 is provided with a plurality of specified recessed portions 58 such that they are arranged side by side in the front-rear direction. The specified recessed portions 58 are provided in the upper end surface 52B of the long wall portion 52 and are recessed toward the lower end surface 52A. Holes 58A that penetrate the first protrusion portion 57 in the up-down direction are respectively formed in bottom wall portions of the specified recessed portions 58. The shape of the holes 58A is a rectangular shape that is long in the front-rear direction in a plan view (refer to FIG. 4). The holes 58A allow the absorption member 48 located below the first protrusion portion 57 to be exposed upward (refer to FIG. 8).

Each of the short wall portions 62 has a second wall portion 63 and a second protrusion portion 67. The second wall portion 63 is provided between the first frame-shaped wall portion 47A (refer to FIG. 4) and the absorption member 48 (refer to FIG. 4). The second wall portion 63 faces the first inner end surface 47C of the first frame-shaped wall portion 47A. The second protrusion portion 67 protrudes from an upper end portion of the second wall portion 63 in a direction from the outer end surface 62C of the short wall portion 62 toward the inner end surface 62D.

The second protrusion portion 67 is directly above an end portion of the absorption member 48 (refer to FIG. 4) in the front-rear direction, and is below the upper end portion of the contact wall portion 47 (refer to FIG. 4) of the cap 40. Both end portions of the second protrusion portion 67 in the left-right direction are respectively provided with specified recessed portions 68. The specified recessed portions 68 are provided in the upper end surface 62B of the short wall portion 62 and are recessed toward the lower end surface 62A. Holes 68A (refer to FIG. 4) that penetrate the second protrusion portion 67 in the up-down direction are respectively formed in bottom wall portions of the specified recessed portions 68. The shape of the holes 68A is a rectangular shape that is long in the left-right direction in a plan view (refer to FIG. 4). The holes 68A allow the absorption member 48 located below the second protrusion portion 67 to be exposed upward (refer to FIG. 4).

An exposure recessed portion 69 is provided in a central portion of each of the second protrusion portions 67 in the left-right direction. The exposure recessed portion 69 is positioned between the two holes 68A in the left-right direction. The exposure recessed portion 69 is provided in an end portion of the second protrusion portion 67 in a direction from the outer end surface 62C toward the inner end surface 62D and is recessed toward the outer end surface 62C. The exposure recessed portions 69 allow the end portions of the absorption member 48 in the front-rear direction to be exposed upward.

Recessed portions 100 that are provided in the base portion 51 of the plate-shaped member 50 will be explained with reference to FIG. 7. For example, the recessed portions 100 include first recessed portions 71 and 72 and second recessed portions 81 to 84. The first recessed portion 71 is formed in one of the pair of short wall portions 62. The first recessed portion 72 is formed in the other of the pair of short wall portions 62. The first recessed portions 71 and 72 have the same shape as each other. Each of the first recessed portions 71 and 72 is provided in the lower end surface 62A and is recessed toward the upper end surface 62B and extends between the outer end surface 62C and the inner end surface 62D of the short wall portion 62. The first recessed portions 71 and 72 are located in positions that are mutually point symmetric with respect to the axis line 39A (refer to FIG. 4).

Inner surfaces of the first recessed portions 71 and 72 are each formed by a pair of opposed surfaces 75 and a bottom wall surface 76. The pair of opposed surfaces 75 are surfaces that face each other with a space therebetween in the left-right direction, and are connected to the lower end surface 62A and the inner end surface 62D of the short wall portion 62. The opposed surfaces 75 are formed in a substantially L shape in a left side view. The bottom wall surface 76 connects the pair of opposed surfaces 75.

The second recessed portions 81 and 82 are formed in one of the pair of long wall portions 52. The second recessed portions 83 and 84 are formed in the other of the pair of long wall portions 52. In this example, the second recessed portions 81 to 84 have the same shape as each other. Each of the second recessed portions 81 to 84 is provided in the outer end surface 52C and is recessed toward the inner end surface 52D and extends between the lower end surface 52A and the upper end surface 52B of the long wall portion 52.

The second recessed portions 81 and 82 are provided such that they are arranged side by side in the front-rear direction with a plurality of the specified recessed portions 58 therebetween. More specifically, the second recessed portions 81 and 82 are respectively provided in two positions that are separated, by different distances, from the suction opening 42A (refer to FIG. 4) of the cap 40. In the plate-shaped member 50 shown in FIG. 4, the distance of separation between the second recessed portion 81 and the suction opening 42A is shorter than the distance of separation between the second recessed portion 82 and the suction opening 42A.

In a similar manner, the second recessed portions 83 and 84 are provided such that they are arranged side by side in the front-rear direction with a plurality of the specified recessed portions 58 therebetween. The second recessed portion 83 is in the same position as the second recessed portion 81 in the left-right direction. The second recessed portion 84 is in the same position as the second recessed portion 82 in the left-right direction. Hereinafter, of the space surrounded by the plate-shaped member 50, an area between the second recessed portions 81 and 83 is referred to as a first area 43 (refer to FIG. 4). An area between the second recessed portions 82 and 84 is referred to as a second area 44 (refer to FIG. 4). In FIG. 4, the first area 43 is located closer to the suction opening 42A than the second area 44.

The second recessed portions 81 and 84 are located in positions that are mutually point symmetric with respect to the axis line 39A. In other words, the position of the second recessed portion 81 formed in one of the pair of long wall portions 52 and the position of the second recessed portion 84 formed in the other of the pair of long wall portions 52 are symmetric with each other. Similarly, the second recessed portions 82 and 83 are located in positions that are mutually point symmetric with respect to the axis line 39A. The position of the second recessed portion 82 formed in one of the pair of long wall portions 52 and the position of the second recessed portion 83 formed in the other of the pair of long wall portions 52 are symmetric with each other.

Inner surfaces of the second recessed portions 81 to 84 are each formed by a pair of extension surfaces 85 and a bottom surface 86. The pair of extension surfaces 85 each extend from the outer end surface 52C of the long wall portion 52 toward the inner end surface 52D. The pair of extension surfaces 85 are inclined such that they become closer to each other as they approach the inner end surface 52D. The bottom surface 86 connects the pair of extension surfaces 85. The bottom surface 86 includes an extension surface 86A and an inclined surface 86B (refer to FIG. 11).

Figure 11:
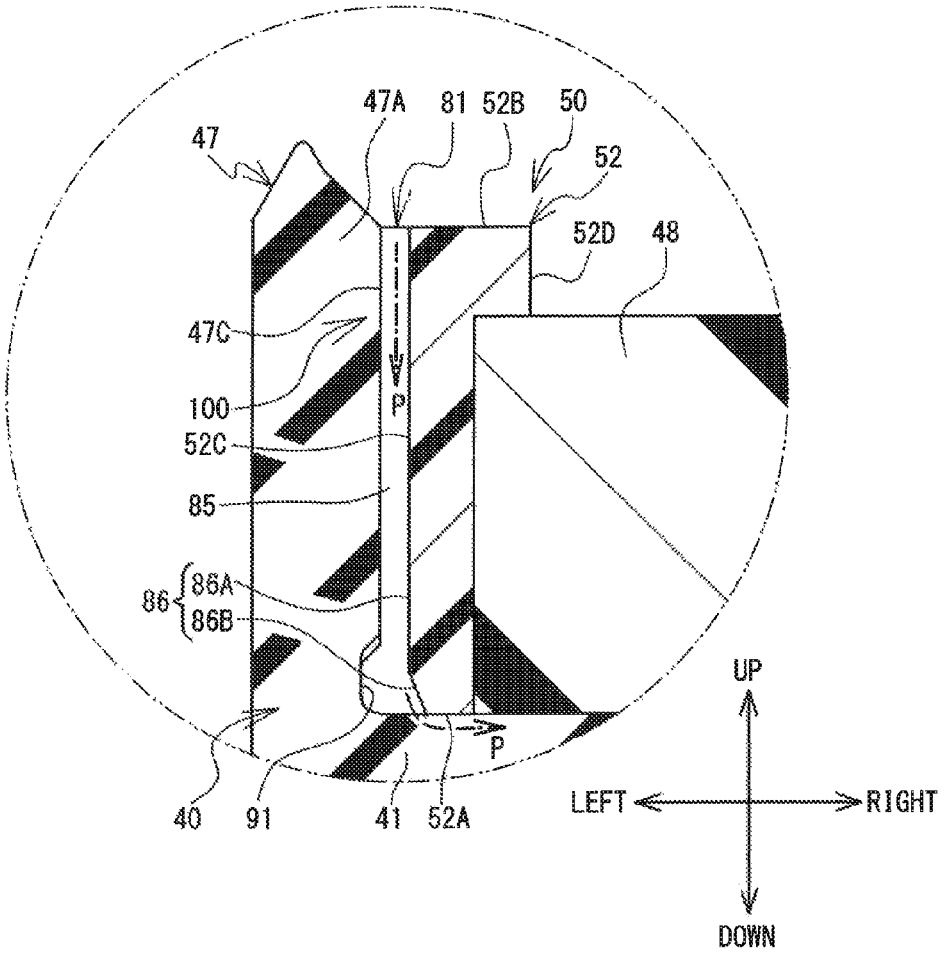
FIG. 11 is a cross-sectional view of a second recessed portion taken along a line C-C in the direction of arrows shown in FIG. 4.

As shown in FIG. 11, the extension surface 86A extends downward from the upper end surface 52B of the long wall portion 52. The extension surface 86A may extend parallel to the up-down direction, or may be inclined with respect to the up-down direction. The inclined surface 86B connects the extension surface 86A and the lower end surface 52A. The inclined surface 86B extends downward from the lower end of the extension surface 86A. As the inclined surface 86B extends downward, it approaches the inner end surface 52D from the outer end surface 52C of the long wall portion 52.

The depth of the second recessed portion 81 shown in FIG. 7 is shown by a dimension H1. The depth of the second recessed portion 81 is, for example, a shortest distance between the outer end surface 52C of the long wall portion 52 and a section (of the bottom surface 86 of the second recessed portion 81) that is closest to the inner end surface 52D of the long wall portion 52. The depth of each of the second recessed portions 82 to 84 is also defined by the same definition as the depth of the second recessed portion 81. Further, the depth of the second recessed portion 82 is shown by a dimension H2. The dimension H1 and the dimension H2 are the same as each other.

The overall structure of the plate-shaped member 80 will be explained with reference to FIG. 4. The plate-shaped member 80 is provided with a base portion 87. The base portion 87 is surrounded by the second frame-shaped wall portion 47B, and is disposed in a position facing a peripheral surface of the absorption member 49. More specifically, the base portion 87 extends along the second inner end surface 47D of the second frame-shaped wall portion 47B such that the second inner end surface 47D and the absorption member 49 are partitioned from each other. The base portion 87 is formed by a pair of long wall portions 88 and a pair of short wall portions 89. The long wall portions 88 extend in the front-rear direction, and the short wall portions 89 extend in the left-right direction. The long wall portions 88 have the same shape as the long wall portions 52 of the plate-shaped member 50. More specifically, the long wall portions 88 are provided with the plurality of specified recessed portions 58 and the second recessed portions 81 to 84. On the other hand, the short wall portions 89 are shorter than the short wall portions 62 in the left-right direction. In the short wall portions 89, although the first recessed portions 71 and 72 are provided, the specified recessed portions 68 and the exposure recessed portion 69 are not provided.

Figure 8:
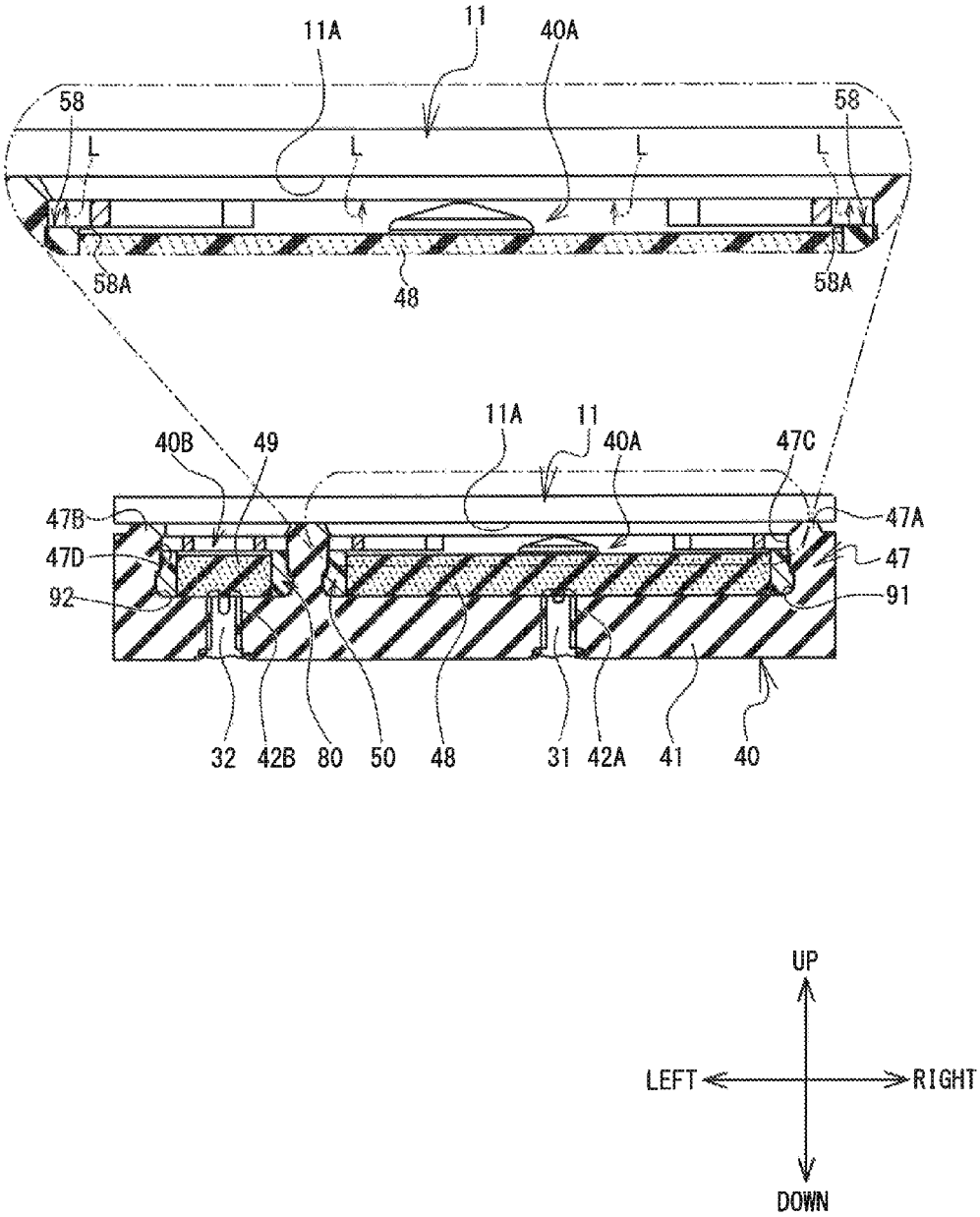
FIG. 8 is a cross-sectional view of the cap that seals an ejection surface.
Figure 9:
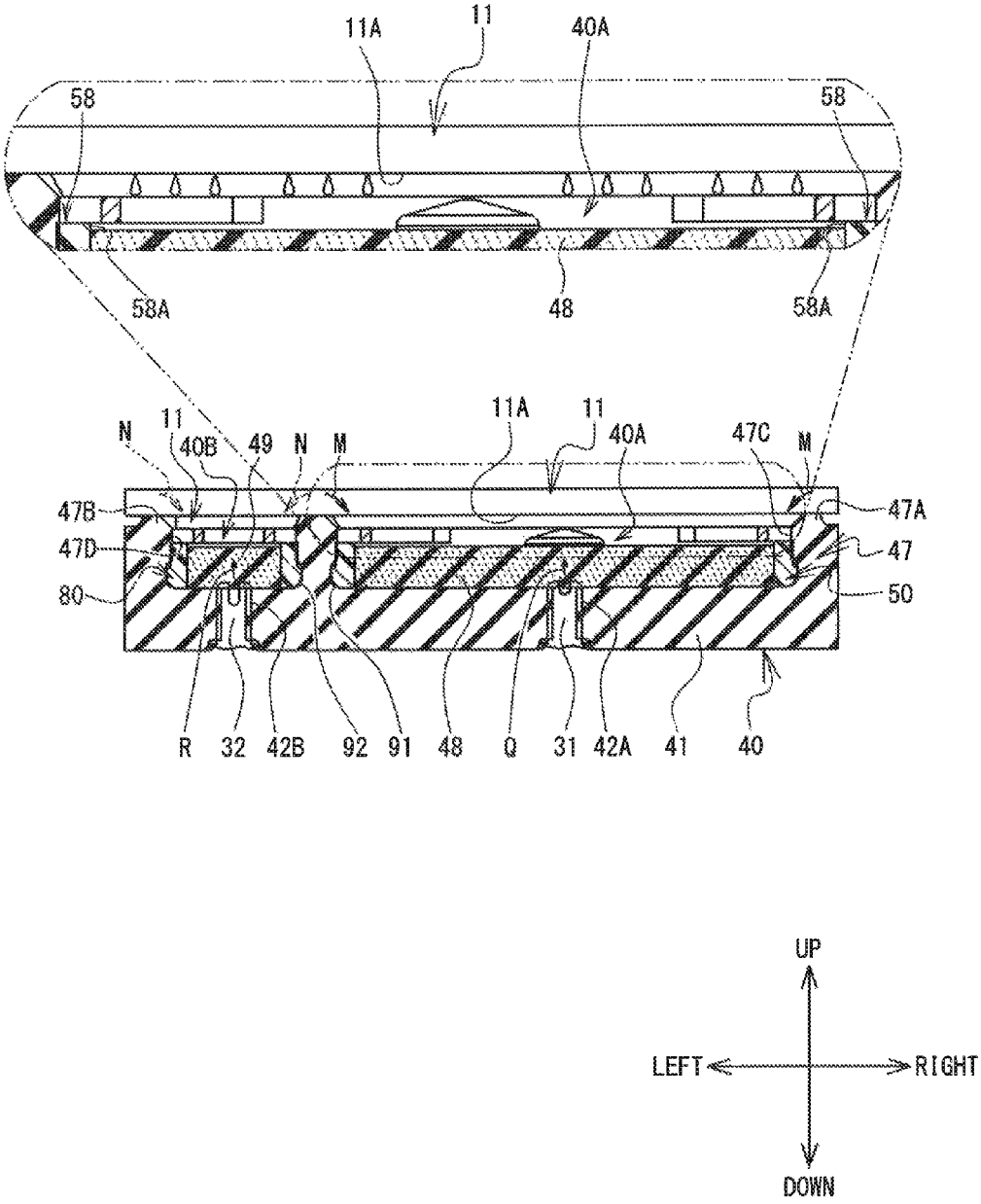
FIG. 9 is a cross-sectional view of a head for which purging is performed.

The operation in which the maintenance mechanism 30 performs capping of the ejection surface 11A of the first head unit 10 will be explained with reference to FIG. 3 and FIG. 8. FIG. 8 and FIG. 9 schematically show a cross section taken along a line B-B in the direction of arrows shown in FIG. 4. Before the maintenance mechanism 30 performs the capping, the carriage 15 is in the standby position (refer to FIG. 1), the contact wall portion 47 of the cap 40 is separated downward from the ejection surface 11A (refer to FIG. 3), and both the first valves and the second valves are in the closed state.

When the vertical movement motor 21 is driven, the holding member 35 moves upward (in the direction of an arrow K in FIG. 3). In accordance with the movement of the holding member 35, the cap 40 moves toward the ejection surface 11A. In other words, the cap 40 moves relative to the ejection surface 11A. As a result, the contact wall portion 47 of the cap 40 comes into contact with the ejection surface 11A of the first head unit 10 (refer to FIG. 8). The upper end portion of the contact wall portion 47 that is in contact with the ejection surface 11A is elastically deformed downward, and is firmly attached to the ejection surface 11A. The first frame-shaped wall portion 47A surrounds the nozzle arrangements 122 to 124 (refer to FIG. 2), and the second frame-shaped wall portion 47B surrounds the nozzle arrangement 121. The ejection surface 11A is sealed, and the maintenance mechanism 30 ends the capping.

In a state in which the ejection surface 11A is sealed, moisture moves upward from each of the absorption members 48 and 49 that have absorbed the liquid. The direction of arrows L shown in FIG. 8 is an example of the direction in which the moisture moves in the right space 40A. In the right space 40A, the moisture moves toward the ejection surface 11A via any one of a prescribed space, the exposure recessed portion 69, the plurality of holes 58A and the plurality of holes 68A. The prescribed space is a space surrounded by the first protrusion portions 57 (refer to FIG. 7) of the respective pair of long wall portions 52 and the second protrusion portions 67 (refer to FIG. 7) of the respective pair of short wall portions 62.

Particularly, the nozzle array at the left end of the nozzle arrangement 122 (refer to FIG. 2) approaches a position above the first protrusion portion 57 of the long wall portion 52 located on the left side. The nozzle array at the right end of the nozzle arrangement 124 (refer to FIG. 2) approaches a position above the first protrusion portion 57 of the long wall portion 52 located on the right side. Thus, via the plurality of holes 58A formed in the long wall portion 52 located on the left side, it is easy for the moisture to be distributed, in the front-rear direction, to the plurality of nozzles 111 of the nozzle array that forms the left end of the nozzle arrangement 122. In a similar manner, via the plurality of holes 58A formed in the long wall portion 52 located on the right side, it is easy for the moisture to be distributed, in the front-rear direction, to the plurality of nozzles 111 of the nozzle array that forms the right end of the nozzle arrangement 124.

Since the moisture moves toward the ejection surface 11A, it is difficult for the nozzle arrangements 122 to 124 to dry out. Therefore, the print device 1 may reduce the possibility of solidification of the meniscus of the white ink formed in each of the nozzles 111 of the nozzle arrangements 122 to 124. The print device 1 may inhibit occurrence of a failure in which the white ink is not ejected from the nozzle arrangements 122 to 124. In a similar manner, also in the left space 40B, the print device 1 may inhibit the nozzle arrangement 121 from drying out.

In this example, the white ink is more likely not to be ejected than the color inks. However, in a state in which the print device 1 has performed the capping, the possibility that the white ink will not be ejected is reduced by the moisture generated from the absorption members 48 and 49.

The purging that is performed for the nozzle arrangements 122 to 124 by the maintenance mechanism 30 will be explained with reference to FIG. 3 and FIG. 9. Before the maintenance mechanism 30 performs the purging, the contact wall portion 47 of the cap 40 is firmly attached to the ejection surface 11A of the first head unit 10, and both the first valves and the second valves are in the closed state.

Of the first valves that are respectively provided in the right tube 23 and the left tube 24, the first valve of the right tube 23 is switched from the closed state to the open state by the control portion (not shown in the drawings). The suction portion 29 is driven, and the pressure in the right space 40 of the cap 40 decreases. As a result, the white ink is discharged from each of the nozzles 111 of the nozzle arrangements 122 to 124 (refer to FIG. 9). The discharged white ink is absorbed by the absorption member 48. After the white ink has been discharged from each of the nozzles 111, the second valve of the right cleaning tube 25 is switched from the closed state to the open state by the control portion (not shown in the drawings). As a result, after the cleaning liquid 22A flows into the right space 40A via the right cleaning tube 25 and the right cleaning path 33, the cleaning liquid 22A is discharged toward the waste liquid tank 16 via the right suction path 31. The second valve is switched from the open state to the closed state by the control portion. After that, the vertical movement motor 21 is driven, and thus the holding member 35 moves downward. As a result, the contact wall portion 47 of the cap 40 moves downward away from the ejection surface 11A of the first head unit 10. The maintenance mechanism 30 ends the purging.

When the suction portion 29 is driven, the pressure in the right space 40A of the cap 40 becomes lower than an atmospheric pressure. Thus, the first frame-shaped wall portion 47A is urged inwardly. The direction of an arrow M shown in FIG. 9 is an example of the direction in which the first-plate shaped wall portion 47A is urged. The hardness of the plate-shaped member 50 is higher than the hardness of the first frame-shaped wall portion 47A, and the plate-shaped member 50 faces the first inner end surface 47C of the first frame-shaped wall portion 47A. Therefore, the first frame-shaped wall portion 47A that is being urged inwardly is restricted from being deformed inwardly by the plate-shaped member 50. Thus, it is difficult for the first frame-shaped wall portion 47A, which is deformed inwardly, to separate from the ejection surface 11A. Therefore, even when the purging is performed, the print device 1 may more accurately maintain the sealed state of the right space 40A of the cap 40.

Further, in the present example, since the pressure of the right space 40A becomes lower than the atmospheric pressure, the bottom wall portion 41 below the right space 40A is urged inwardly. The direction of an arrow Q shown in FIG. 9 is an example of the direction in which the bottom wall portion 41 is urged. Since the bottom wall portion 41 below the right space 40A is deformed inwardly, the plate-shaped member 50 is likely to be lifted from the bottom wall portion 41. Note that when the pressure of the right space 40A returns to the pressure before the execution of the purging, the deformed bottom wall portion 41 returns to its original shape. At this time, the plate-shaped member 50 sometimes maintains the state in which it is lifted from the bottom wall portion 41 or sometimes moves downward to a position where it comes into contact with the bottom wall portion 41.

Although a detailed explanation will be omitted, purging that is performed for the nozzle arrangement 121 by the maintenance mechanism 30 is similar to the above-described purging that is performed for the nozzle arrangements 122 to 124. More specifically, after the first valve provided in the left tube 24 (refer to FIG. 3) switches to the open state, the suction portion 29 is driven. Since the pressure of the left space 40B decreases, the white ink is discharged from the nozzle arrangement 121. In this case, the second frame-shaped wall portion 47B, and the bottom wall portion 41 that is below the left space 40B are each urged inwardly. The second frame-shaped wall portion 47B is restricted from being deformed inwardly by the plate-shaped member 80. On the other hand, since the urged bottom wall portion 41 is deformed inwardly, the plate-shaped member 80 is lifted from the bottom wall portion 41. Note that the direction of an arrow N shown in FIG. 9 is an example of the direction in which the second frame-shaped wall portion 47B is urged. The direction of an arrow R is an example of the direction in which the bottom wall portion 41 below the left space 40B is urged.

Figure 10:
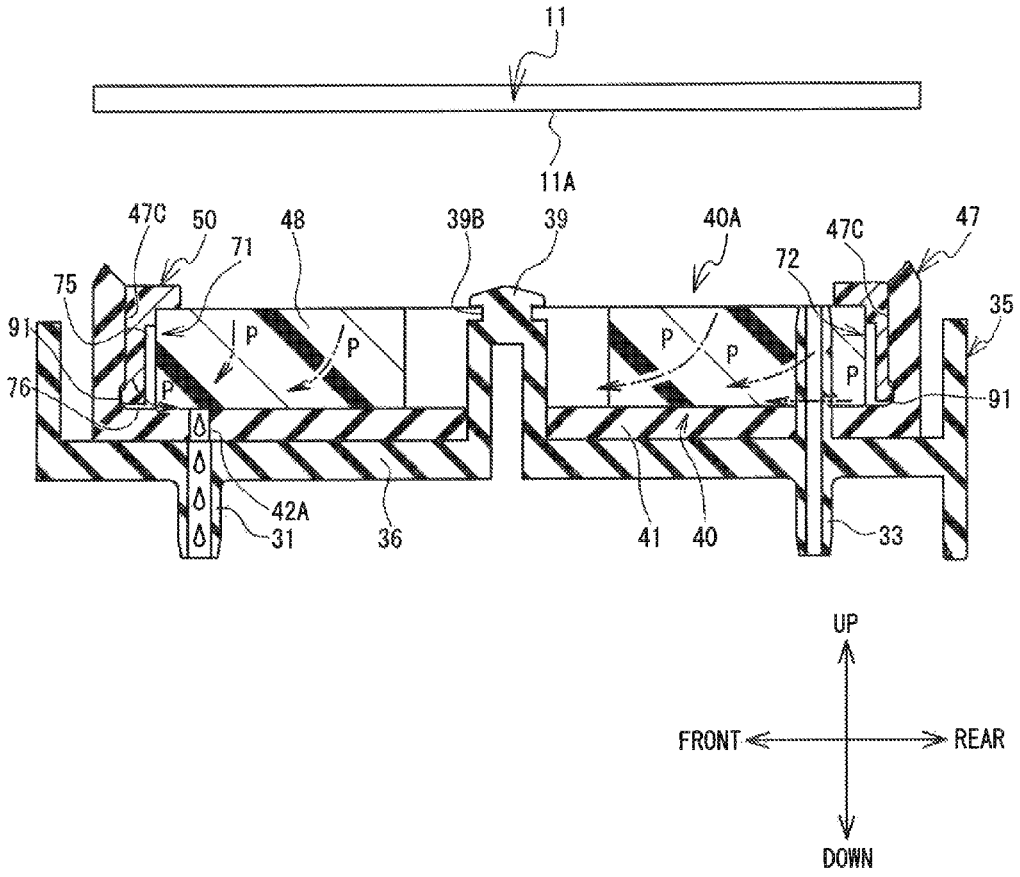
FIG. 10 is a cross-sectional view of the cap in which an air flow is generated.

The operation in which the maintenance mechanism 30 performs the idle suction will be explained with reference to FIG. 4, FIG. 7, FIG. 10 and FIG. 11. After performing the purging, the maintenance mechanism 30 performs the idle suction. FIG. 10 schematically shows a cross section taken along a line A-A in the direction of arrows shown in FIG. 4. Further, in FIG. 10 and FIG. 11, a state in which the plate-shaped member 50 is in contact with the bottom wall portion 41 is shown as an example. Hereinafter, the idle suction that sucks droplets remaining in the absorption member 48 will be explained as an example of the idle suction operation. The droplets remaining in the absorption member 48 are droplets of the white ink, droplets of the cleaning liquid 22A or the like, for example. Before the maintenance mechanism 30 performs the idle suction, both the first valves and the second valves are in the closed state.

The second valve of the right tube 23 (refer to FIG. 3) is switched from the closed state to the open state by the control portion (not shown in the drawings). After that, when the suction portion 29 is driven, an air flow toward the suction opening 42A is generated in the right space 40A of the cap 40. Directions of arrows P shown in FIG. 4, FIG. 7, FIG. 10 and FIG. 11 are examples of the directions of the air flow generated inside the right space 40A. The droplets absorbed by the absorption member 48 move toward the right suction path 31 via the suction opening 42A, due to the air flow generated inside the right space 40A. The droplets that have moved as far as the right suction path 31 are sucked by the suction portion 29 via the right tube 23 (refer to FIG. 3), and thereafter discharged to the waste liquid tank 16 (refer to FIG. 3).

The air flow generated inside the right space 40A includes a first air flow, a second air flow and a third air flow. The first air flow is an air flow generated inside the first recessed portions 71 and 72, and is an air flow that moves toward the right suction path 31 via the first recessed portions 71 and 72 (refer to FIG. 4 and FIG. 10). The second air flow is an air flow generated inside the second recessed portions 81 to 84, and is an air flow that moves toward the right suction path 31 via the second recessed portions 81 to 84 (refer to FIG. 4 and FIG. 11). The third air flow is an air flow generated inside the second recessed portions 81 to 84, and is an air flow that moves toward the right suction path 31 via the first groove portion 91 (refer to FIG. 5 and FIG. 6) of the first frame-shaped wall portion 47A and the first recessed portion 71 (refer to FIG. 7), in that order. Therefore, in the right space 40A, the possibility that the air flow will be generated in a certain area in particular is lower than in a case where the recessed portions 100 are not formed in the plate-shaped member 50.

The second air flow is likely to be generated when the plate-shaped member 50 maintains the state in which it is lifted from the bottom wall portion 41. Even when the plate-shaped member 50 is in contact with the bottom wall portion 41, it is temporarily lifted from the bottom wall portion 41 or deformed when the maintenance mechanism 30 performs the purging. As a result, it is likely that a slight gap is generated between the bottom wall portion 41 and the second recessed portions 81 to 84. Therefore, the second air flow is generated even when the plate-shaped member 50 is in contact with the bottom wall portion 41. Note that, when the plate-shaped member 50 is in contact with the bottom wall portion 41, there is a case in which the second air flow is not generated.

Further, for example, the second air flow includes an air flow that moves toward the suction opening 42A via the first area 43 and an air flow that moves toward the suction opening 42A via the second area 44. The distance of separation between the suction opening 42A and the second area 44 is longer than the distance of separation between the suction opening 42A and the first area 43. Therefore, in the second area 44, in comparison to the first area 43, the air flow toward the suction opening 42A is less likely to be generated, and even when the air flow is generated, it tends to be weaker. However, the depth of the second recessed portions 82 and 84 is the same as the depth of the second recessed portions 81 and 83. Thus, it is less likely that the air flow generated in the second area 44 is weaker than the air flow generated in the first area 43.

Although a detailed explanation will be omitted, the operation of the maintenance mechanism 30 that sucks droplets remaining in the absorption member 49 is similar to the above-described operation of the maintenance mechanism 30 that sucks the droplets remaining in the absorption member 48. More specifically, after the first valve provided in the left tube 24 (refer to FIG. 3) is switched to the open state by the control portion (not shown in the drawings), the suction portion 29 is driven. An air flow toward the suction opening 42B is generated (not shown in the drawings) inside the left space 40B. The suction portion 29 sucks the droplets remaining in the absorption member 49 via the suction opening 42B, the left suction path 32 and the left tube 24. The possibility that the air flow will be generated in a certain area in particular inside the left space 40B is lower than in a case where the first recessed portions 71 and 72 and the second recessed portions 81 to 84 of the plate-shaped member 80 are not provided.

An example of a method for arranging the plate-shaped member 50 on the holding member 35 will be explained with reference to FIG. 4. In the explanation below, a rotation position around the axis line 39A of the plate-shaped member 50 shown in FIG. 4 is referred to as a first rotation position. After the absorption member 48 is arranged in the left space 40A, the plate-shaped member 50 is arranged in the right space 40A. The shape of the base portion 51 is point symmetric with respect to the axis line 39A. Therefore, even when the plate-shaped member 50 is in a second rotation position where the plate-shaped member 50 has been rotated by 180 degrees around the axis line 39A from the first rotation position, the plate-shaped member 50 can be arranged in the right space 40A.

The first recessed portions 71 and 72 are located in positions that are mutually point symmetric with respect to the axis line 39A. Similarly, the second recessed portions 81 and 84 are located in positions that are mutually point symmetric with respect to the axis line 39A, and the second recessed portions 82 and 83 are located in positions that are mutually point symmetric with respect to the axis line 39A. Thus, even when the plate-shaped member 50 is in the second rotation position, positional relationships of the first recessed portions 71 and 72 with respect to the suction opening 42A, and positional relationships of the second recessed portions 81 to 84 with respect to the suction opening 42A do not change. More specifically, even when the plate-shaped member 50 is in the second rotation position and is arranged in the right space 40A, it is likely that the air flow toward the suction opening 42A is uniformly generated in the right space 40A in accordance with the idle suction performed by the maintenance mechanism 30. As described above, the rotation positions of the plate-shaped member 50 that can be arranged in the right space 40A include the first rotation position and the second rotation position.

As explained above, the suction portion 29 is connected to the inside of the cap 40 via the suction opening 42A. When the suction portion 29 is driven in accordance with the purging performed by the maintenance mechanism 30, the plate-shaped member 50 restricts the inward deformation of the first frame-shaped wall portion 47A. Therefore, the print device 1 may easily secure the sealing performance of the inside of the cap 40 when the purging is performed. Further, when the suction portion 29 is driven in accordance with the idle suction performed by the maintenance mechanism 30, at least one of the first air flow, the second air flow and the third air flow is likely to be generated inside the cap 40. As a result, a degree of suction unevenness in the absorption member 48 decreases. Thus, it is easy for the print device 1 to uniformly suck the droplets generated inside the cap 40.

Since the droplets generated inside the cap 40 are uniformly sucked, the droplets remaining in the cap 40 are unlikely to attach to the ejection surface 11A. Thus, the print device 1 may reduce the possibility that the droplets may attach to the meniscus of the white ink formed in each of the nozzles 111. Accordingly, the print device 1 may easily maintain the meniscus of the white ink formed in each of the nozzles 111.

The second recessed portions 81 to 84 of the recessed portions 100 are formed in the long wall portions 52. It is easy for the long wall portions 52 to have more sections that face the first inner end surface 47C of the first frame-shaped wall portion 47A than the short wall portions 62. Therefore, even when the rigidity of the plate-shaped member 50 decreases as a result of the second recessed portions 81 to 84 being formed, it is easy for the print device 1 to restrict the deformation of the first frame-shaped wall portion 47A. Further, the plurality of second recessed portions 81 to 84 are formed in the long wall portions 52. Therefore, when the maintenance mechanism 30 performs the idle suction, the air flow toward the suction opening 42A is easily generated. Thus, it is easy for the print device 1 to uniformly suck the droplets generated in the absorption member 48.

The depth of the second recessed portion 82 is the same as the depth of the second recessed portion 81, and is not shallower than the depth of the second recessed portion 81. Similarly, the depth of the second recessed portion 84 is not shallower than the depth of the second recessed portion 83. Therefore, the air flow generated in the second area 44 is unlikely to be weaker than the air flow generated in the first area 43. Thus, when the suction portion 29 is driven in accordance with the idle suction performed by the maintenance mechanism 30, the degree of suction unevenness in the absorption member 48 is further reduced.

The inclined surface 86B of each of the second recessed portions 81 to 84 extends upward from the lower end surface 52A. As each of the inclined surfaces 86B extends upward, it approaches the outer end surface 62C from the inner end surface 52D of the long wall portion 52. When the maintenance mechanism 30 performs the idle suction, the second air flow is likely to move along the inclined surfaces 86B toward the suction opening 42A located on the inside of the base portion 51. Therefore, when the maintenance mechanism 30 performs the idle suction, the degree of suction unevenness in the absorption member 49 is further reduced.

The first recessed portions 71 and 72 are respectively formed in the short wall portions 62. At least the upper end portion of each of the short wall portions 62 is formed to extend in the left-right direction. Therefore, the rigidity of the short wall portions 62 in the front-rear direction is maintained easily. Thus, the print device 1 may reduce the degree of suction unevenness in the absorption member 49 while maintaining the rigidity of the short wall portions 62. Further, the rotation position of the plate-shaped member 50 that can be arranged in the right space 40A includes the first rotation position and the second rotation position. Therefore, even when the rotation position around the axis line 39A of the plate-shaped member 50 is reversed, the plate-shaped member 50 can be arranged in the right space 40A.

Note that the present disclosure is not limited to the above-described embodiment, and various modifications are possible. For example, the first head unit 10 may eject the color inks instead of ejecting the white ink. Instead of being formed of a resin material, the plate-shaped member 50 may be formed of, for example, a rubber material having a higher hardness than the rubber material used to form the cap 40. The base portion 51 of the plate-shaped member 50 may be formed in a frame shape by a plurality of members. In this case, gaps may be formed between the plurality of members. Further, instead of the cap 40 moving upward and being firmly attached to the ejection surface 11A, the first head unit 10 may move downward and the ejection surface 11A may be firmly attached to the contact wall portion 47.

The depth of each of the second recessed portions 82 and 84 that are provided on both the left and right sides of the second area 44 may be deeper than the depth of each of the second recessed portions 81 and 83 that are provided on both the left and right sides of the first area 43. In this case, when the maintenance mechanism 30 performs the idle suction, the air flow via the second area 44 is easily generated. Further, the air flow via the second area 44 is even less likely to be weaker than the air flow via the first area 43.

At least one of the plurality of specified recessed portions 58 and 68 and the first recessed portions 71 and 72 need not necessarily be provided in the base portion 51 of the plate-shaped member 50. Hereinafter, a plate-shaped member according to this modified example is referred to as a first plate-shaped member. The first plate-shaped member has a shape that is point symmetric around the axis line 39A, and has a shape that is symmetric in the up-down direction. Therefore, regardless of whether one end surface of the first plate-shaped member in the up-down direction is directed upward or downward, the first plate-shaped member can be arranged in the right space 40A.

The recessed portions 100 need not necessarily include the first recessed portion 72 and the second recessed portions 81 to 84, and may include the first recessed portion 71 only. In this case, the first recessed portion 71 may be formed in the long wall portion 52, instead of being provided in the short wall portion 62. Similarly, the recessed portions 100 need not necessarily include the first recessed portions 71 and 72 and the second recessed portions 82 to 84, and may include the second recessed portion 81 only. In this case, the second recessed portion 81 may be formed in the short wall portion 62, instead of being provided in the long wall portion 52.

The second recessed portions 81 and 82 may be respectively provided in two positions where distances of separation from the suction opening 42A are the same as each other. For example, the suction opening 42A may be provided in the center position of the pair of opposing corners of the base portion 51 (refer to FIG. 4) of the plate-shaped member 50. In this case, distances of separation between the suction opening 42A and each of the second recessed portions 81 to 84 are the same. Further, at least one of the second recessed portions 81 to 84 need not necessarily be provided with the inclined surface 86B. In this case, for example, the extension surface 86A may connect the upper end surface 52B and the lower end surface 52A.

The first recessed portions 71 and 72 need not necessarily have the same shape. For example, the length of the first recessed portion 72 in the left-right direction may be longer than the length of the first recessed portion 71 in the left-right direction. In this case, the first recessed portion 72 may be disposed in a position that is further separated from the suction opening 42A than the first recessed portion 71.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

I claim:

1. A print device comprising:

a head having an ejection surface, the ejection surface having a plurality of nozzles formed in the ejection surface and being directed in a predetermined direction;

a cap having a frame-shaped wall portion and a suction opening, the frame-shaped wall portion being formed by an elastic body, the frame-shaped wall portion being configured to relatively move in a direction in which the frame-shaped wall portion comes into contact with and separates from the ejection surface, the frame-shaped wall portion surrounding the plurality of nozzles when the frame-shaped wall portion comes into contact with the ejection surface, and the suction opening being formed in a position surrounded by the frame-shaped wall portion;

a suction portion connected to the inside of the cap via the suction opening;

an absorption member arranged in a position surrounded by the frame-shaped wall portion and configured to absorb liquid, the absorption member extending in a first direction and a second direction, the first direction being a direction orthogonal to the predetermined direction, the second direction being a direction orthogonal to the predetermined direction and intersecting with the first direction; and a plate-shaped member arranged in a position surrounded by the frame-shaped wall portion and extending along an inner end surface of the frame-shaped wall portion, the plate-shaped member having a first surface, a second surface, a third surface, a fourth surface and a recessed portion, the first surface being directed in the predetermined direction, the second surface being directed in an opposite direction, the opposite direction being a direction opposite to the predetermined direction, the third surface facing the inner end surface of the frame-shaped wall portion and connecting the first surface and the second surface, the recessed portion including at least one of a first recessed portion and a second recessed portion, the first recessed portion being provided in the first surface and being recessed toward the second surface and extending between the third surface and the fourth surface, the first recessed portion being positioned in the first direction side with respect to the absorption member in a state in which the absorption member is arranged in a position surrounded by the plate-shaped member, and the second recessed portion being provided in the third surface and being recessed toward the fourth surface and extending in the predetermined direction from the opposite direction end of the second surface to the predetermined direction end of the first surface, the second recessed portion being positioned in at least one of the first direction side and the second direction side with respect to the absorption member in a state in which the absorption member is arranged in the position surrounded by the plate-shaped member.

2. The print device according to claim 1, wherein the plate-shaped member has a first extension portion and a second extention portion, the first extension portion extending in the second direction, the second extension portion extending in the first direction, and a length of the second extension portion in the first direction being longer than a length of the first extension portion in the second direction, and the recessed portion is formed in the second extension portion.

3. The print device according to claim 2, wherein the recessed portion is formed in a plurality in the second extension portion.

4. The print device according to claim 2, wherein the recessed portion includes the first recessed portion, the first recessed portion being formed in the first extension portion.

5. The print device according to claim 2, wherein the plate-shaped member is a frame formed by a pair of the first extension portions and a pair of the second extension portions, the recessed portion is formed in each of the pair of second extension portions, and a position of the recessed portion provided in one of the pair of second extension portions and a position of the recessed portion provided in the other of the pair of second extension portions are symmetric with each other.

6. The print device according to claim 1, wherein the recessed portion includes a plurality of the second recessed portions, the plurality of the second recessed portions including a third recessed portion and a fourth recessed portion respectively provided in two positions where distances of separation from the suction opening are different from each other, the third recessed portion being provided in a first position that is one of the two positions, the fourth recessed portion being provided in a second position that is the other of the two positions, a distance of separation between the second position and the suction opening being shorter than a distance of separation between the first position and the suction opening, and the third recessed portion having a depth deeper than a depth of the fourth recessed portion.

7. The print device according to claim 1, wherein the recessed portion includes the second recessed portion, the second recessed portion having a first extension surface, a second extension surface and an inclined surface, the first extension surface extending from the third surface in a third direction, the third direction being a direction from the third surface toward the fourth surface, the second extension surface extending in the third direction from the third surface, the second extension surface facing the first extension surface with a gap between the first extension surface and the second extension surface, and the inclined surface extending in the predetermined direction as the inclined surface approaches in the third direction, and the inclined surface being connected to the first extension surface, the second extension surface, and the first surface.

8. A print device comprising:

a head having an ejection surface, the ejection surface having a plurality of nozzles formed in the ejection surface and being directed in a predetermined direction;

a cap having a frame-shaped wall portion and a suction opening, the frame-shaped wall portion being formed by an elastic body, the frame-shaped wall portion being configured to relatively move in a direction in which the frame-shaped wall portion comes into contact with and separates from the ejection surface, the frame-shaped wall portion surrounding the plurality of nozzles when the frame-shaped wall portion comes into contact with the ejection surface, and the suction opening being formed in a position surrounded by the frame-shaped wall portion;

a holding member holding the cap therein, the holding member including a wall portion extending along an extending direction of the ejection surface, the wall portion including a suction path, the suction path being provided on a position corresponding to the suction opening;

a suction portion connected to the inside of the cap via the suction opening and the suction path;

an absorption member arranged in a position surrounded by the frame-shaped wall portion and configured to absorb liquid, the wall portion being provided on a predetermined direction side with respect to the absorption member; and a plate-shaped member arranged in a position surrounded by the frame-shaped wall portion, configured to surround the absorption portion, and extending along an inner end surface of the frame-shaped wall portion, the plate-shaped member having a first surface, a second surface, a third surface, and a fourth surface, the first surface being directed in the predetermined direction, the second surface being directed in an opposite direction, the opposite direction being a direction opposite to the predetermined direction, the third surface facing the inner end surface of the frame-shaped wall portion and connecting the first surface and the second surface, the fourth surface facing the absorption member and connecting the first surface and the second surface, the first surface being provided on an opposite direction side with respect to the wall portion, the fourth surface being provided further to a side of the frame-shaped wall portion in the extending direction of the ejection surface than the suction opening.

* * * * *